US008469147B2

(12) United States Patent
Myers et al.

(10) Patent No.: US 8,469,147 B2
(45) Date of Patent: Jun. 25, 2013

(54) CHEST STRAP ARRANGEMENT FOR AN ATTACHABLE ARRANGEMENT

(75) Inventors: Grant M. Myers, Pittsburgh, PA (US); Jeremy A. Steck, Pittsburgh, PA (US)

(73) Assignee: Mine Safety Appliances Company, Pittsburgh, PA (US)

( * ) Notice: Subject to any disclaimer, the term of this patent is extended or adjusted under 35 U.S.C. 154(b) by 208 days.

(21) Appl. No.: 13/008,163

(22) Filed: Jan. 18, 2011

(65) Prior Publication Data

US 2011/0174573 A1 Jul. 21, 2011

Related U.S. Application Data

(60) Provisional application No. 61/296,981, filed on Jan. 21, 2010.

(51) Int. Cl.
*A62B 35/00* (2006.01)

(52) U.S. Cl.
USPC ..... 182/3; 24/200

(58) Field of Classification Search
USPC ..... 182/3; 24/200, 161, 115 F; 297/250.1
See application file for complete search history.

(56) References Cited

U.S. PATENT DOCUMENTS

| | | | | |
|---|---|---|---|---|
| 1,541,701 | A * | 6/1925 | Gaunt | 24/321 |
| 4,712,513 | A | 12/1987 | Huppertsberg | |
| 5,433,289 | A * | 7/1995 | O'Rourke | 182/3 |
| 5,957,091 | A | 9/1999 | McDonald et al. | |
| 6,038,747 | A * | 3/2000 | Hamilton et al. | 24/164 |
| 6,056,626 | A * | 5/2000 | Fildan | 450/86 |
| 6,253,874 | B1 * | 7/2001 | Casebolt et al. | 182/3 |
| 6,804,830 | B2 | 10/2004 | Reynolds et al. | |
| 6,848,959 | B2 * | 2/2005 | Miller | 441/88 |
| 6,904,648 | B2 * | 6/2005 | Fildan et al. | 24/302 |
| 7,004,362 | B2 * | 2/2006 | Boone | 224/161 |
| 7,198,541 | B2 * | 4/2007 | Falla | 450/86 |
| 2003/0145435 | A1 | 8/2003 | Carver | |

FOREIGN PATENT DOCUMENTS

| | | |
|---|---|---|
| DE | 8914878 U1 | 4/1991 |
| FR | 2427828 | 1/1980 |
| GB | 1566704 | 5/1980 |

* cited by examiner

*Primary Examiner* — Alvin Chin Shue
(74) *Attorney, Agent, or Firm* — The Webb Law Firm

(57) ABSTRACT

A chest strap arrangement for an attachable arrangement removably attachable to a user and having a first torso strap and a second torso strap. The chest strap arrangement includes: a strap member with a first portion and a second portion; a first buckle having at least one substantially horizontal slot through which the first torso strap extends; and a second buckle having at least one substantially horizontal slot through which the second torso strap extends. In one embodiment, the cross sectional thickness of at least a portion of an outer end area of a buckle is greater than the cross sectional thickness of at least a portion of an inner end area of the buckle.

17 Claims, 8 Drawing Sheets

CHEST STRAP ARRANGEMENT FOR AN ATTACHABLE ARRANGEMENT

CROSS REFERENCE TO RELATED APPLICATIONS

This application claims benefit of priority from U.S. Provisional Patent Application No. 61/296,981, filed Jan. 21, 2010, which is incorporated herein by reference in its entirety.

BACKGROUND OF THE INVENTION

1. Field of the Invention

The present invention relates generally to attachable arrangements, e.g., harnesses, fall protection arrangements, and the like, which include multiple elongate straps, and in particular to a chest strap arrangement for use in connection with such an attachable arrangement.

2. Description of the Related Art

As is known in the art, there exist various embodiments and arrangements that are attachable to a person to provide assistance to the wearer or ensure the wearer's safety in certain situations. Such attachable arrangements come in many forms, including, but not limited to, harnesses, safety belts, climbing harnesses, fall protection harnesses, safety harnesses, fall protection arrangements, etc. While there are many variations in such attachable arrangements, all normally include one or more elongate straps that are adjustable to fit different wearers. In operation, a person will don the attachable arrangement, attach the straps around the specified parts of his or her body, and adjust these straps to fit comfortably, yet effectively.

For example, full body harnesses are widely used for lifting and lowering individuals in dangerous situations and as a primary component in a personal fall arrest system. These harnesses can also be used for work positioning, travel restriction, ladder climbing, rescue retrieval, and evacuation. While these harnesses are used mainly in an industrial setting, and particularly the construction industry where the likelihood and danger of falls from heights is both numerous and significant, a full body harness can be used in various other applications in which total suspension and support of the body must be ensured, either expectedly or unexpectedly. Various harnesses are illustrated in U.S. Pat. Nos. 6,804,830; 5,957,091; and 4,712,513, all of which are incorporated herein by reference.

In a full body harness (or similar fall protection arrangement and system), a chest strap is often provided and extends across the chest or torso area of a user. According to the prior art, various types of chest strap arrangements may be utilized, depending upon the requirements of the harness, the environment in which the user is working, the fall protection needs, and other such safety-related issues. For example, a chest strap may be permanently attached between a first and a second torso strap. Such attachment may occur through the permanent stitching of a first portion of the chest strap to the first torso strap, and the second portion of the chest strap to the second torso strap. Also, such permanent attachment may be achieved though the engagement of each torso strap with a respective buckle, where each buckle is also in operative engagement with the chest strap.

In another known arrangement, a plastic slider buckle is permanently positioned on each torso strap, such that the slider buckle can be adjusted up and down a respective torso strap. Further, a first end of the chest strap may be looped around an exposed portion of the first torso strap, permanently stitched to itself, and engaged to a first slider buckle; and the second end of the chest strap is looped around an exposed portion of the second torso strap, permanently stitched to itself, and engaged to a second slider buckle. Accordingly, the entire chest strap arrangement can be moved up and down the torso of the user by moving the slider buckles. The slider buckle is only used to assist in adjustment of the chest strap, but does not serve to attach the chest strap to the torso straps.

In yet another known arrangement, the chest strap arrangement is in two parts, including: a first strap portion having a first end connected to the first torso strap and a second end having engagement hardware; and a second strap portion having a first end connected to the second torso strap and a second end having engagement hardware that is releasably engageable with the engagement hardware of the first strap portion. In this manner, the user can engage and disengage the chest strap for use in donning and/or removing the attachable arrangement. One known engaging arrangement or hardware includes a first attaching structure in the form of a first plate member having a substantially vertical slot and attached to the second strap portion, and a second attaching structure in the form of a second plate member attached to the first strap portion. When the second plate member is inserted through the substantially vertical slot of the first plate member, it bears against a surface thereof.

In addition, certain attachable arrangements require the placement and usage of a D-ring member attached to a portion of the chest strap, whether in one or more parts. This D-ring member is usually attached to a lanyard or other fall protection mechanism, which is also attached to a secure point in the worker's environment. The D-ring member is used to safely connect the worker to the secure point, and must sustain considerable force in case of a fall. In view of this, the chest strap, attachment structures and associated chest strap components must also be sufficiently strong, and also must meet certain existing fall protection standards and tests.

As can be seen, there are a variety of types and styles of attachable arrangements that use a chest strap and associated hardware. However, as with the attachable arrangement as an overall unit, a primary purpose of the chest strap portion is to protect the user in dangerous situations or conditions. Therefore, there is room in the art for improved attachable arrangements and, in the case of the present invention, chest strap arrangements, which lead to enhanced safety to the worker. Further, providing both improved ease of donning/removing and comfort during operation are also important factors with room for improvement in the art.

SUMMARY OF THE INVENTION

Generally, the present invention provides a chest strap arrangement for use in connection with an attachable arrangement, and which overcomes some or all of the drawbacks and deficiencies associated with the prior art. Preferably, the present invention provides a chest strap arrangement that, in certain preferred and non-limiting embodiments, is adjustable to fit a variety of different users. Preferably, the present invention provides a chest strap arrangement that, in certain preferred and non-limiting embodiments, integrates certain attaching structures and hardware for use in connecting the chest strap arrangement to at least one torso strap of an attachable arrangement. Preferably, the present invention provides a chest strap arrangement that, in certain preferred and non-limiting embodiments, assists in diverting one or both of the torso straps away from the torso area of a user, which increases the comfort and distribution of force in the event of a fall. Preferably, the present invention provides a chest strap arrangement that, in certain preferred and non-limiting embodiments, permits independent adjustment of the chest strap along the length of the torso strap, and independent of the torso strap adjustment. Preferably, the present invention provides a chest strap arrangement that, in certain preferred and non-limiting embodiments, reduces the chances for slippage of the chest strap arrangement in a fall situation.

Accordingly, in one preferred and non-limiting embodiment, provided is a chest strap arrangement for an attachable arrangement removably attachable to a user and having a first torso strap and a second torso strap. The chest strap arrangement includes: a strap member with a first portion and a second portion; a first buckle having an inner end area and an outer end area, and at least one substantially horizontal slot extending through at least a portion of the outer end area through which the first torso strap extends, wherein the first buckle is directly or indirectly engaged with the first portion of the strap member; and a second buckle having an inner end area and an outer end area, and at least one substantially horizontal slot extending though at least a portion of the outer end area through which the second torso strap extends, wherein the second buckle is directly or indirectly engageable with the second portion of the strap member. The cross sectional thickness of at least a portion of the outer end area of at least one of the first buckle and the second buckle is greater than the cross sectional thickness of at least a portion of the inner end area of the at least one of the first buckle and the second buckle.

In another preferred and non-limiting embodiment, provided is a chest strap arrangement for an attachable arrangement removably attachable to a user and having a first torso strap and a second torso strap. The chest strap arrangement includes: a strap member with a first portion and a second portion; a first buckle having an inner end area and an outer end area, and at least one substantially horizontal slot extending through at least a portion of the outer end area through which the first torso strap extends, wherein the first buckle is directly or indirectly engaged with the first portion of the strap member; and a second buckle having an inner end area and an outer end area, and at least one substantially horizontal slot extending though at least a portion of the outer end area through which the second torso strap extends, wherein the second buckle is directly or indirectly engageable with the second portion of the strap member. The inner end area of the second buckle comprises a first attaching structure, and the chest strap further includes a second attaching structure engaged with the second portion of the strap member and configured to operatively interact with the first attaching structure.

In a further preferred and non-limiting embodiment, provided is a chest strap arrangement for an attachable arrangement removably attachable to a user and having a first torso strap and a second torso strap. The chest strap arrangement includes: at least one strap member; a first buckle having an inner end area and an outer end area, and at least one substantially horizontal slot extending through at least a portion of the outer end area through which the first torso strap extends, wherein the first buckle is directly or indirectly engaged with a portion of the at least one strap member; a second buckle having an inner end area and an outer end area, and at least one substantially horizontal slot extending though at least a portion of the outer end area through which the second torso strap extends, wherein the second buckle is directly or indirectly engaged with a portion of the at least one strap member; and a frame member positioned adjacent a rear surface of at least one of the first buckle and the second buckle.

These and other features and characteristics of the present invention, as well as the methods of operation and functions of the related elements of structures and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention. As used in the specification and the claims, the singular form of "a", "an", and "the" include plural referents unless the context clearly dictates otherwise.

BRIEF DESCRIPTION OF THE DRAWINGS

FIG. 4(*b*) is a side, cross sectional view of second buckle of the chest strap arrangement of FIG. 3;

FIG. 7(*b*) is a front view of the chest strap arrangement of FIG. 7(*a*) with a D-ring member attached thereto;

FIG. 8(*b*) is a front view of another embodiment of a frame member of a chest strap arrangement according to the principles of the present invention;

DETAILED DESCRIPTION OF THE PREFERRED EMBODIMENTS

Figure 1:
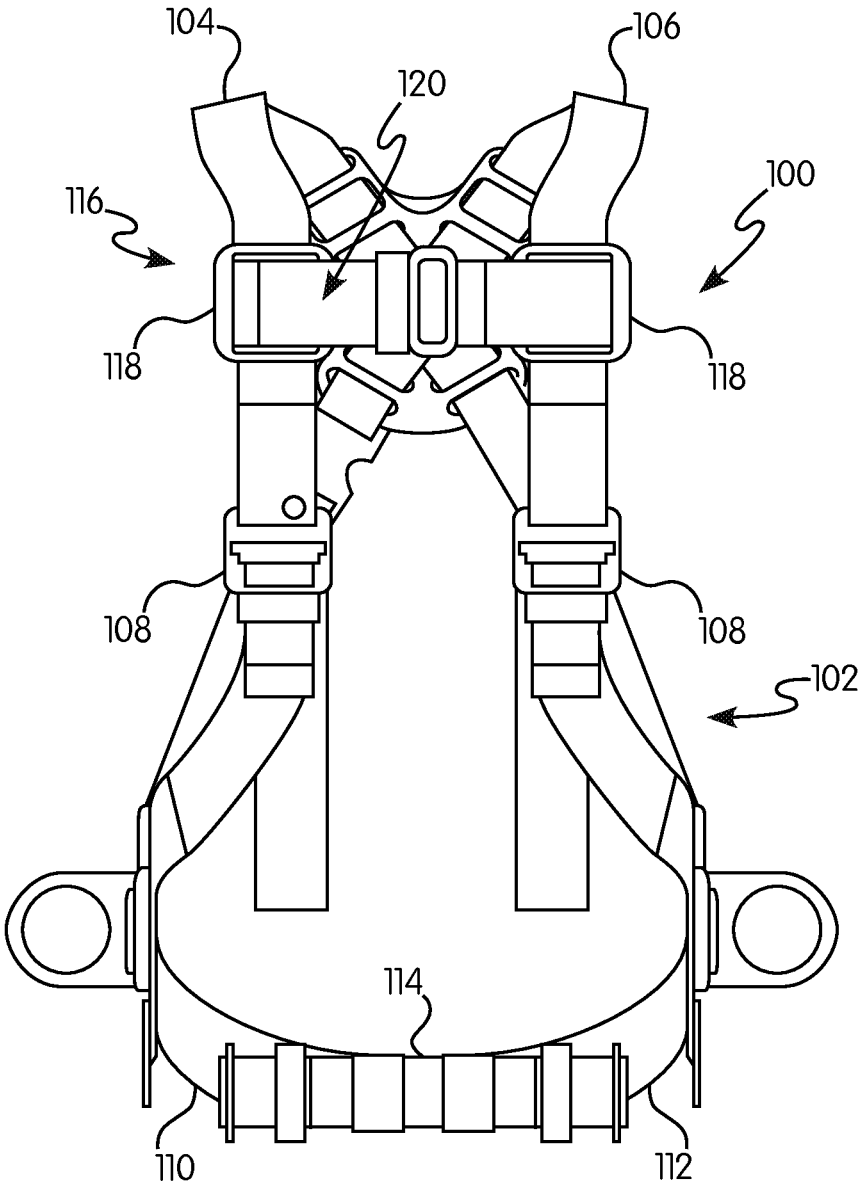
FIG. 1 (Prior Art)
FIG. 1 is a front view of an attachable arrangement according to the prior art.

For purposes of the description hereinafter, the terms "end", "upper", "lower", "right", "left", "vertical", "horizontal", "top", "bottom", "lateral", "longitudinal" and derivatives thereof shall relate to the invention as it is oriented in the drawing figures. However, it is to be understood that the invention may assume various alternative variations and step sequences, except where expressly specified to the contrary. It is also to be understood that the specific devices and processes illustrated in the attached drawings, and described in the following specification, are simply exemplary embodiments of the invention. Hence, specific dimensions and other physical characteristics related to the embodiments disclosed herein are not to be considered as limiting. For example, the term "end" may refer to the extreme distal portion or the area near or adjacent that portion.

As discussed above, and according to the existing prior art, a known attachable arrangement 100 is illustrated in FIG. 1. In particular, this attachable arrangement 100 includes at least one, and typically many, elongate straps 102. As illustrated in FIG. 1, the attachable arrangement (e.g., a harness) includes a first torso strap 104 and a second torso strap 106. Each torso strap 104, 106 is attached at one end to an adjustment mechanism 108, and preferably, such attachment is a permanent connection made by passing an end of the torso strap 104, 106 through a slot in the adjustment mechanism 108, and sewing the end to the torso strap 104, 106 to form a closed loop. The attachable arrangement 100 further includes two leg straps 110, 112 (preferably identical) and a sub-pelvic strap 114. Each leg strap 110, 112 is attached at one point to the torso strap 104, 106, and again, preferably, such an attachment is a permanent connection made by sewing. Other connections and arrangements are known, such as a harness where each leg strap either extends and becomes, or is attached to, a respective torso adjustment strap.

Figure 2:
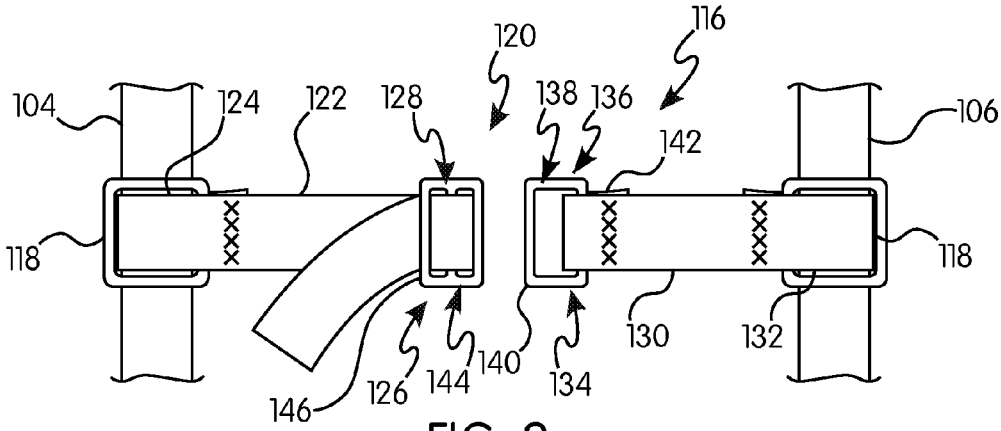
FIG. 2 (Prior Art)
FIG. 2 is a front view of chest strap arrangement according to the prior art as connected to torso straps of an attachable arrangement.

As discussed above, the attachable arrangement 100 of FIG. 1 includes a chest strap arrangement 116, which extends across the chest or torso area of a user. As illustrated in FIG. 2, the known chest strap arrangement 116 includes a slider buckle 118 permanently positioned on each torso strap 104, 106, such that the slider buckle 118 can be adjusted up and down a respective torso strap 104, 106. A chest strap 120 includes: a first strap portion 122 having a first end 124 connected to the first torso strap 104 and a second end 126 having engagement hardware 128; and a second strap portion 130 having a first end 132 connected to the second torso strap 106 and a second end 134 having engagement hardware 136 that is releasably engageable with the engagement hardware 128 of the first strap portion 122. This permits the user to engage and disengage the chest strap arrangement 116 for use in donning and/or removing the attachable arrangement 100.

In order to engage the chest strap 120 with both of the torso straps 104, 106, and as best illustrated in FIG. 2, the first end 124 of the first strap portion 122 of the chest strap 120 is looped around an exposed portion of the first torso strap 104, permanently stitched to itself, and engaged to the first slider buckle 124; and the first end 132 of the second strap portion 130 of the chest strap 120 is looped around an exposed portion of the second torso strap 106, permanently stitched to itself, and engaged to the second slider buckle 128. In addition, the engagement hardware includes: a first attaching structure 138 in the form of a first plate member 140 having a substantially vertical slot 142 and attached to the second strap portion 130, and a second attaching structure 144 in the form of a second plate member 146 attached to the first strap portion 122. In particular, the second plate member 142 is inserted through the substantially vertical slot 138 of the first plate member 136 and bears against a surface thereof.

The present invention is directed to a chest strap arrangement 10, and various preferred and non-limiting embodiments of this chest strap arrangement 10 are illustrated in FIGS. 3-13. It is further noted that the present invention is useful in connection with a variety of attachable arrangements 100, including, but not limited to, harnesses, climbing harnesses, safety harnesses, fall protection arrangements, full body harnesses, and the like.

Figure 3:
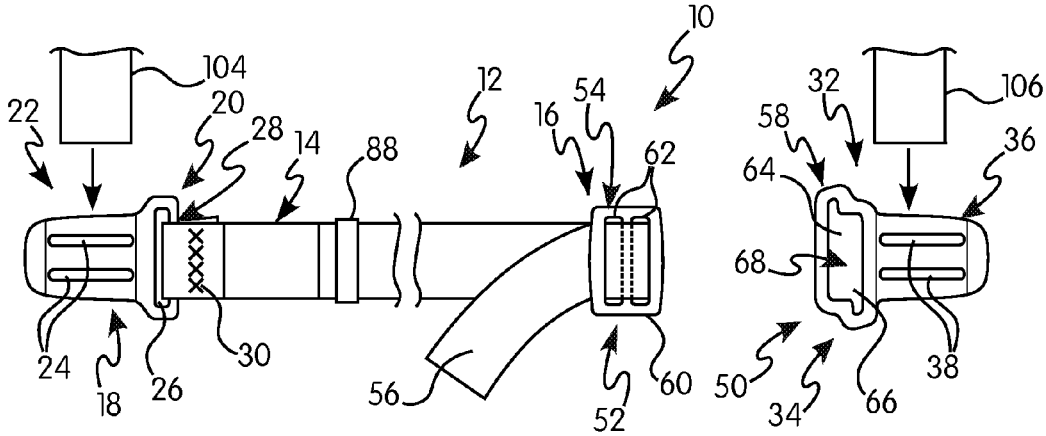
FIG. 3 is a front view of one embodiment of a chest strap arrangement according to the principles of the present invention.

In one preferred and non-limiting embodiment, and with reference to FIG. 3, the chest strap arrangement 10 includes a strap member 12 having a first portion 14 and a second portion 16. Further, the chest strap arrangement 10 includes a first buckle 18 with an inner end area 20 and an outer end area 22, as well as at least one (and typically two) horizontal slots 24 extending through a portion of the outer end area 22 of the first buckle 18. These horizontal slots 24 are of a sufficient width such that the first torso strap 104 can extend up through one of the horizontal slots 24 and down through the other horizontal slot 24, thereby engaging the first buckle 18 and the torso strap 104 in a manner known in the art. Of course, any attachment between the first buckle 18 and the first torso strap 104 is envisioned. For example, the first torso strap 104 and/or the second torso strap 106 may be a two-ply torso strap arrangement, with multiple layers each extending through the horizontal slots 24.

The inner end area 20 of the first buckle 18 includes a vertical slot 26, and as with the horizontal slots 24, the vertical slot 26 is appropriately sized such as to receive the first portion 14 of the strap member 12 therethrough. In particular, a first end 28 of the first portion 14 of the strap member 12 is inserted through the vertical slot 26 and looped around the inner end area 20, and thereafter, attached to itself (as represented by the stitching 30). In this manner, the first portion 14 of the strap member 12 is permanently attached to the first buckle 18, although other permanent or removable, direct or indirect, and similar engagement arrangements can be utilized.

In this preferred and non-limiting embodiment of the chest strap arrangement 10, a second buckle 32 is included and has an inner end area 34 and an outer end area 36. In addition, and as with the first buckle 18, the second buckle 32 includes two horizontal slots 38 extending through at least a portion of the outer end area 36. The second torso strap 106 is attached to and inserted through the horizontal slots 38 in a similar manner as the first torso strap 104, i.e., the second torso strap 106 is fed up through one of the horizontal slots 38 and down through the other horizontal slot 38 to permanently engage the second buckle 32 to the second torso strap 106. Further, the second buckle 32 is directly or indirectly engageable with the second portion 16 of the strap member 12, thereby forming the attachable chest strap arrangement 10 extending across a chest or torso area of a user. Again, and as discussed above, the first torso strap 104 and the second torso strap 106 can be fed through the horizontal slots 24, 38 more than once, or as a two-ply structure, as is known in the art. In addition, at least a portion of the first buckle 18 and/or the second buckle 32 is formed from a metal, an alloy, a powdered metal, a synthetic material, a stamped material, a molded material, or any combination thereof.

Figure 4A:
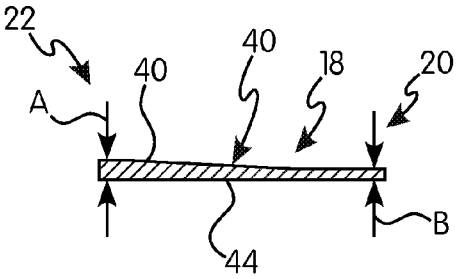
FIG. 4(*a*) is a side, cross sectional view of a first buckle of the chest strap arrangement of FIG. 3.
Figure 4B:
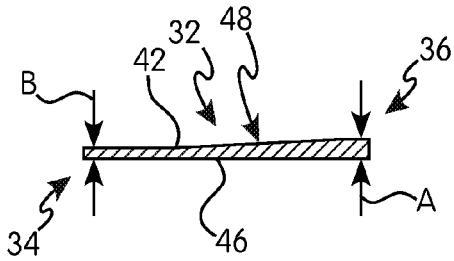

As illustrated in FIG. 4(*a*), and in this preferred and non-limiting embodiment, the cross sectional thickness A of at least a portion of the outer end area 22 of the first buckle 18 is greater than the cross sectional thickness B of at least a portion of the inner end area 20 of the first buckle 18. Further, as illustrated in FIG. 4(*b*), the cross sectional thickness A of at least a portion of the outer end area 36 of the second buckle 32 is greater than the cross sectional thickness B of at least a portion of the inner end area 34 of the second buckle 32. Based upon having thicker outer end areas 22, 36, the first buckle 18 and second buckle 32 urge the respective torso straps 104, 106 into a curved or deflected position extending towards the user's hips, i.e., the structure of the first buckle 18 and the second buckle 32 (based upon the thicker outer end areas 22, 36) diverts or deflects the torso straps 104, 106 away from the torso area of the user. See FIG. 5. This diversion or deflection occurs based upon the greater distance that one side of the torso straps 104, 106 travel in contact with the buckle outer end areas 22, 36 with respect to the distance that the other side of the torso straps 104, 106 travel in contact with the buckle inner end areas 20, 34. In addition, this variation in cross sectional thickness also serves to urge the strap member 12 away from the user's chest or torso area, by specifically urging the inner end areas 20, 34 of the buckles 18, 32 away from the user. Accordingly, such a unique arrangement leads to a more ergonomic structure and usage of the chest strap arrangement 10 and attachable arrangement 100.

As further illustrated in FIGS. 4(*a*) and 4(*b*), the region of greater cross sectional thickness is located at an inner wall 40 of the first buckle 18 and inner wall 42 of the second buckle 32, such that an outer wall 44 of the first buckle 18 and an outer wall 46 of the second buckle 32 are substantially flat. Accordingly, the cross sectional thickness of the first buckle 18 and second buckle 32 increases in a direction towards the outer end areas 22, 36, thereby forming a sloped portion 48 on the inner walls 40, 42. Of course, this sloped portion 48 may take a variety of forms and shapes, and the increasing cross sectional thickness can be formed in any desirable direction or amount in order to achieve the above-described functions of diverting the torso straps 104, 106 towards the user's hips, as well as urging the strap member 12 away from the user's chest or torso area. For example, both the inner and outer walls may be sloped, thus forming a V-shape. Further, either one or both of the first buckle 18 and second buckle 32 may include this unique cross sectional thickness and shape. However, in this preferred and non-limiting embodiment, the sloped portion 48 is located on the rear surface (i.e., inner walls 40, 42) of both buckles 18, 32.

In a further preferred and non-limiting embodiment, the inner end area 34 of the second buckle 32 is in the form of a first attaching structure 50. Further, a second attaching structure 52 is attached to or engaged with a second end 54 of the second portion 16 of the strap member 12. Again, it should be noted that this "second end" 54 may refer to either the distal end of the second portion 16 of the strap member 12 or, preferably, the "end" or portion of the second portion 16 of the strap member 12 that is positioned nearest to the first attaching structure 50 of the second buckle 32.

Accordingly, and as is known, the second portion 16 of the strap member 12 may be looped around or otherwise associated with the second attaching structure 52 with excess strappage 56 extending therefrom. This excess strappage 56 is used to allow the user to adjust the second attaching structure 52, and thereby adjust the length of the second portion 16 of the strap member 12. This, in turn, allows the chest strap arrangement 10 to be adjustable and fit different sizes of torsos and chest areas of the different users. In any case, the first attaching structure 50 and the second attaching structure 52 are configured, sized, and/or shaped to operatively interact and releasably connect to each other. Accordingly, the first attaching structure 50 and the second attaching structure 52 are releasably engageable with each other.

In the preferred and non-limiting embodiment of FIG. 3, the first attaching structure 50 is in the form of a plate member 58 with a generally vertical slot 68, and, in this embodiment, the second attaching structure 52 is in the form of a plate member 60. The plate member 60 is insertable through the vertical slot 68 of the second buckle 32 and at least partially bears against a surface, preferably the outer wall 46 of the second buckle 32. In order to engage the second portion 16 of the strap member 12 to the second attaching structure 52, the plate member 60 includes two vertical slots 62, where the second portion 16 of the strap member 12 is inserted up through one of the vertical slots 62, and down through the other vertical slot 62 to provide adjustable attachment (as is known in the art). As discussed above, the excess strappage 56 may be used to adjust the second portion 16 of the strap member 12 back and forth through these vertical slots 62 in order to adjust the length of the strap member 12.

As also illustrated in FIG. 3, and in this particular embodiment of the present invention, the vertical slot 68 is formed by a first slot portion 64 that is connected to and vertically misaligned with a second slot portion 66. Based upon the relative sizes of the plate member 60 and the shaped slot 68, the user may diagonally insert the plate member 60 through the shaped slot 68 and reorient it in a substantially vertical position. Through such positioning and reorientation, the plate member 60 will then bear against the outer wall 46 of the second buckle 32 (again, due to the connected, but vertically misaligned, first slot portion 64 and second slot portion 66).

Figure 5:
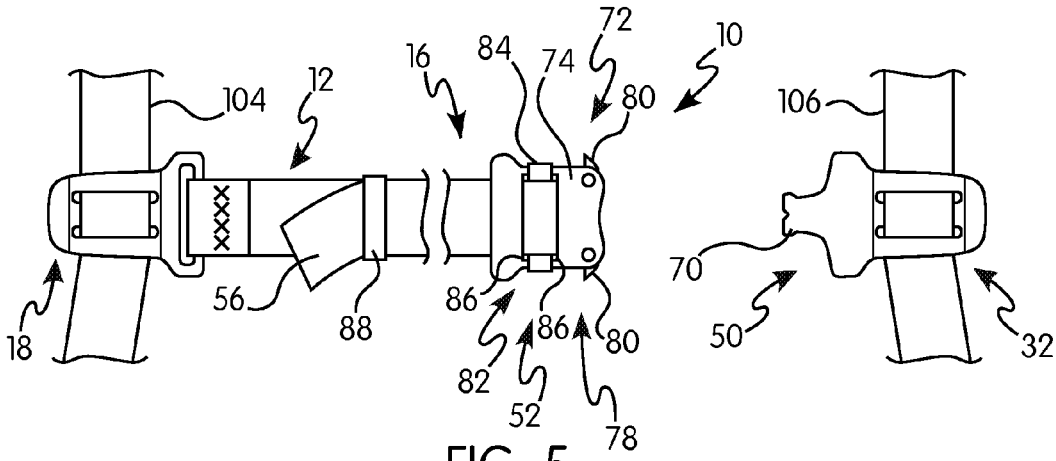
FIG. 5 is a front view of another embodiment of a chest strap arrangement according to the principles of the present invention.

A further embodiment of the chest strap arrangement 10 of the present invention is illustrated in FIG. 5. While the first buckle 18 is similar to the previously-discussed embodiment, the second buckle 32 includes a shaped projection 70 as the first attaching structure 50. Further, the second attaching structure 52 is in the form of a receiving member 72. The receiving member 72 includes a body 74 defining an insertion slot 76 that is sized and shaped so as to at least partially receive the shaped projection 70 therein. In this manner, the first attaching structure 50 is connectable and/or engageable with the second attaching structure 52.

In a further embodiment, the receiving member 72 is in the form of an actuatable release mechanism 78 that is operable to releasably engage the shaped projection 70 from its connection within the body 74 through the insertion slot 76. In order to effect this releasable engagement operation, the release mechanism 78 (or at least some internal component of the release mechanism 78) may also be actuated by one or more actuation members 80 positioned on the exterior of the body 74 of the receiving member 72. In particular, the actuation members 80 may be in the form of one or more buttons that can be pressed by the user to disengage one or more internal components of the receiving member 72 from the shaped projection 70.

Further, in the illustrated embodiment of FIG. 5, the receiving member 72 includes a buckle portion 82 that permits attachment of the second portion 16 of the strap member 12 thereto. As shown, this buckle portion 82 may include a slidable bar 84 that forms two vertical slots 86 that operate as discussed above in connection with the horizontal slots of the first buckle 18 and the second buckle 32, i.e., the second portion 16 of the strap member 12 is fed through both vertical slots 86 and around the bar 84 in order to adjustably engage the strap member 12.

Figure 6:
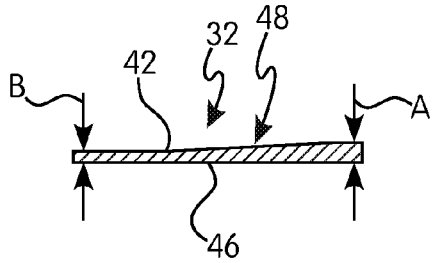
FIG. 6 is a side, cross sectional view of a second buckle of the chest strap arrangement of FIG. 5.

As also illustrated in the preferred and non-limiting embodiments of FIGS. 3 and 5, a strap retainer 88 may be provided. This strap retainer 88 is in the form of a loop extending around the strap member 12, which permits at least a portion of the excess strappage 56 to be fed therethrough. Still further, the second buckle 32 may include the increasing cross sectional thickness as discussed above in connection with the second buckle 32 of the embodiment of FIG. 3. This increasing cross sectional thickness (from B towards A) is illustrated in FIG. 6.

Figure 7A:
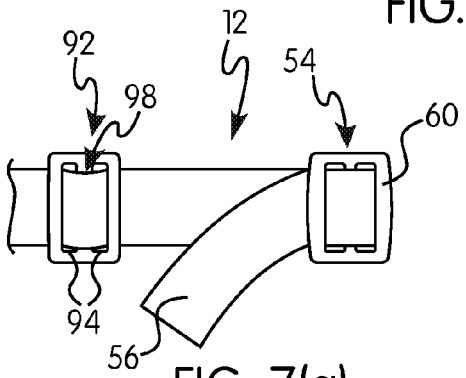
FIG. 7(*a*) is a front view of a further embodiment of a chest strap arrangement according to the principles of the present invention.
Figure 7B:
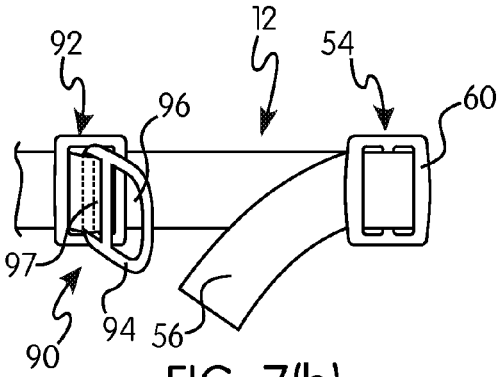

In some situations, a D-ring member 90 is required for use in connection with the attachable arrangement 100, and this D-ring member 90 can be operationally engaged with the chest strap arrangement 10, as shown in FIG. 7(*b*). FIG. 7(*a*) shows an embodiment of the chest strap arrangement 10 that includes a second attaching 52 in the form of a plate member 60, wherein a central buckle 92 is used. The central buckle 92 includes two vertical slots 94, and the strap member 12 is fed through the vertical slots 94 of this central buckle 92 in the manner discussed above. Further, the strap member 12 can be arranged to include a vertical slot 98. It is this slot 98 that is used in connecting the D-ring member 90, as shown in FIG. 7(*b*). Also, as discussed above, the strap member 12 may be fed through the slots 94 more than once, or as a two-ply material, in order to increase strength in the arrangement and additional securing of the D-ring member 90.

With reference to FIG. 7(*b*), the D-ring member 90 includes a frame member 95 defining a central opening 96 and at least one slot 97. In order to attach the D-ring member 90 to the strap member 12, the strap member 12 is fed through a vertical slot 94 of the central buckle 92, through the slot 97 of the D-ring member 90, and down through the other vertical slot 94 of the central buckle 92. This permanently attaches the D-ring member 90 to the strap member 12, and thus the chest strap arrangement 10.

Figure 8A:
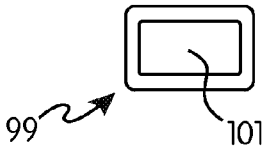
FIG. 8(*a*) is a front view of one embodiment of a frame member of a chest strap arrangement according to the principles of the present invention.
Figure 8B:
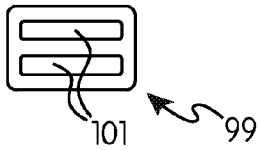
Figure 9:
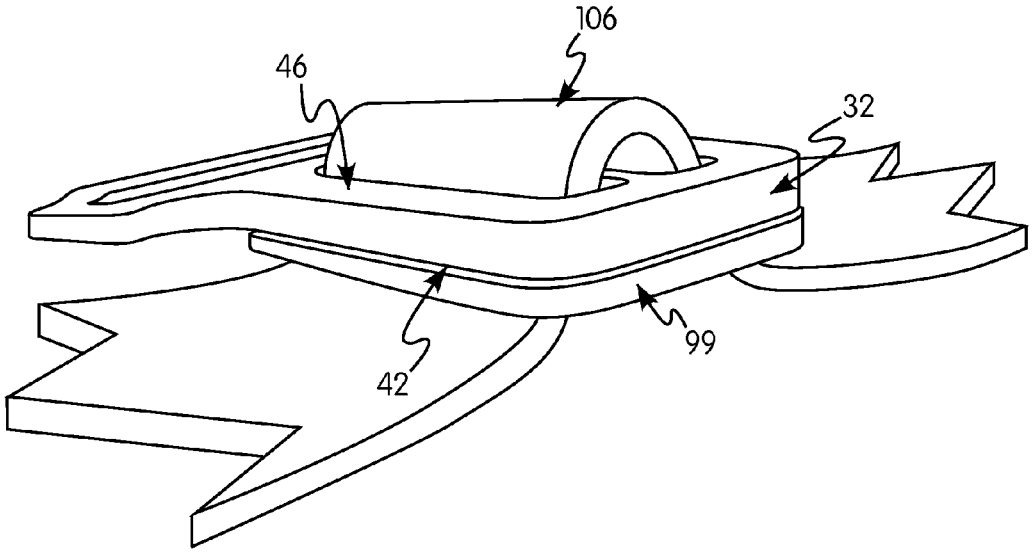
FIG. 9 is a perspective view of the frame member of FIG. 8(*a*) as used in connection with the second buckle of FIG. 3.

In a still further preferred and non-limiting embodiment, and as illustrated in FIGS. 8-12, a frame member 99 can be specifically positioned in connection with the first buckle 18 and/or the second buckle 32. As seen in FIG. 8(*a*), this frame member 99 includes an opening 101, which, in this embodiment is a central opening 101. Further, and as illustrated in FIG. 9 in connection with the second buckle 32, the frame member 99 is positioned against and abutting the inner wall 42 of the second buckle 32. The second torso strap 106 is fed up through the opening 101, further through one of the horizontal slots 38 of the second buckle 32, back through the other horizontal slot 38 of the second buckle, and down through the opening 101. Of course, multiple feeding or a two-ply structure of the torso strap 104, 106 can be used in connection with the frame member 99.

Based upon the abutting arrangement between the frame member 99 and the second buckle 32, and when a load occurs on the chest strap arrangement 10 (such as when using the D-ring member 90), the second buckle 32 rotates, slips, and/or moves with respect to the frame member 99 dependent upon the type and direction of applied load. Upon rotation, slippage or movement, the second buckle 32 and frame member 99 together pinch the torso strap 106 and clamp against it. Again, this is based upon the use of both the second buckle 32 (and its slots 38) and the frame member 99 (with the opening 101). This pinching or clamping effect will eliminate (or at least drastically reduce) the chance of slippage of the torso strap 106 through the second buckle 32. The size and shape of the opening 101 can be varied to increase the rotation, slippage, and/or movement to increase or vary the "pinching" effect that occurs during a load situation.

Figure 10:
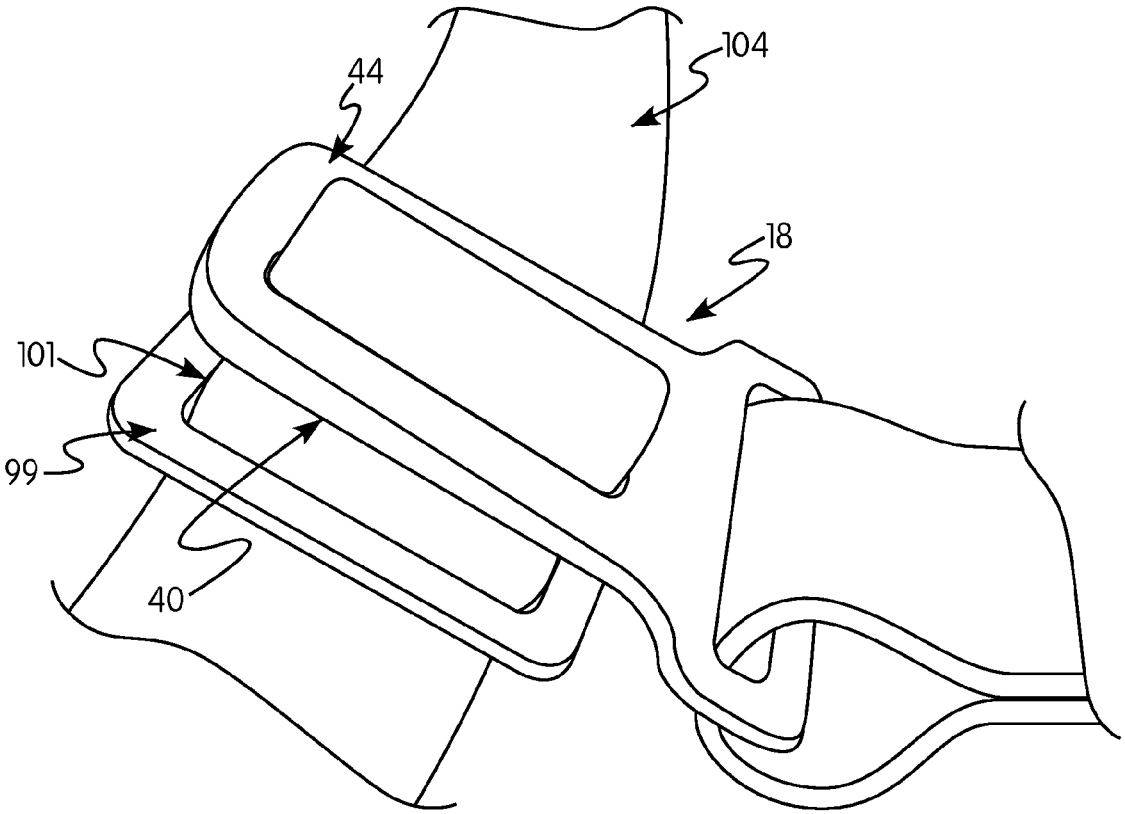
FIG. 10 is a perspective view of the frame member of FIG. 8(*a*) as used in connection with the first buckle of FIG. 3.
Figure 11:
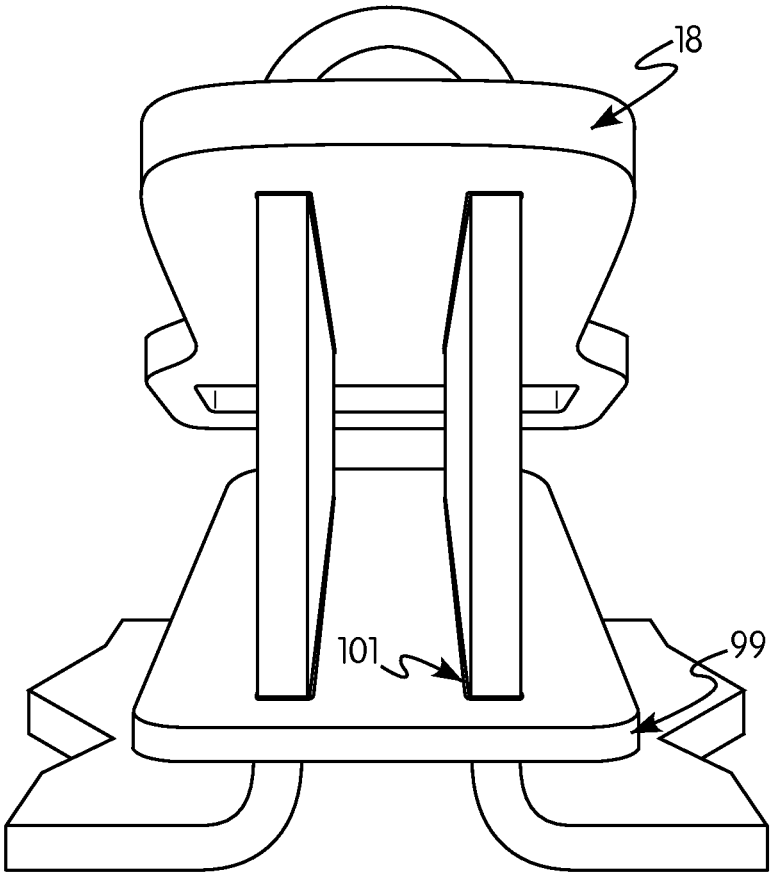
FIG. 11 is a further perspective view of the frame member of FIG. 8(*a*) as used in connection with the first buckle of FIG. 3.
Figure 12:
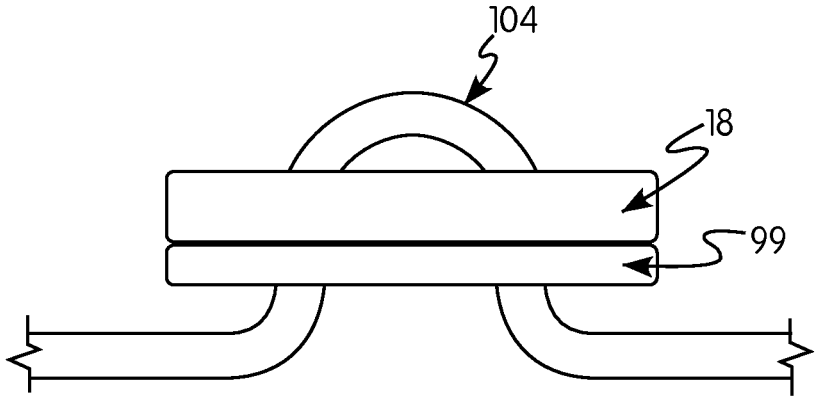
FIG. 12 is a still further perspective view of the frame member of FIG. 8(*a*) as used in connection with the first buckle of FIG. 3.

As illustrated in FIGS. 10-12 in various positions (for clarity), the frame member 99 may also be used in connection with the first buckle 18. The operation and relative rotation, slippage, and/or movement between the first buckle 18 and frame member 99 cause the same "pinching" or clamping function discussed above. When used in connection with both the first buckle 18 and the second buckle 32, the chances of either the first torso strap 104 or the second torso strap 106 slipping or moving through, respectively, the first buckle 18 or the second buckle 32 is either drastically reduced or eliminated.

A further preferred and non-limiting embodiment of the frame 99 is illustrated in FIG. 8(*b*). When using this embodiment of the frame 99, two horizontal openings 101 are provided and substantially aligned with the horizontal slots of the buckles 18, 32. In operation, the torso straps 104, 106 are fed up through a respective one of the horizontal slots 101 of the frame member 99, further through a respective one of the horizontal slots of the buckles 18, 32, back through the other horizontal slot of the buckles 18, 32, and down through the other horizontal slot 101 of the frame member 99. Of course, the horizontal openings 101 can be sized and shaped so as to increase or adjust the "pinching" or clamping effect caused by loading the chest strap arrangement 10.

Figure 13:
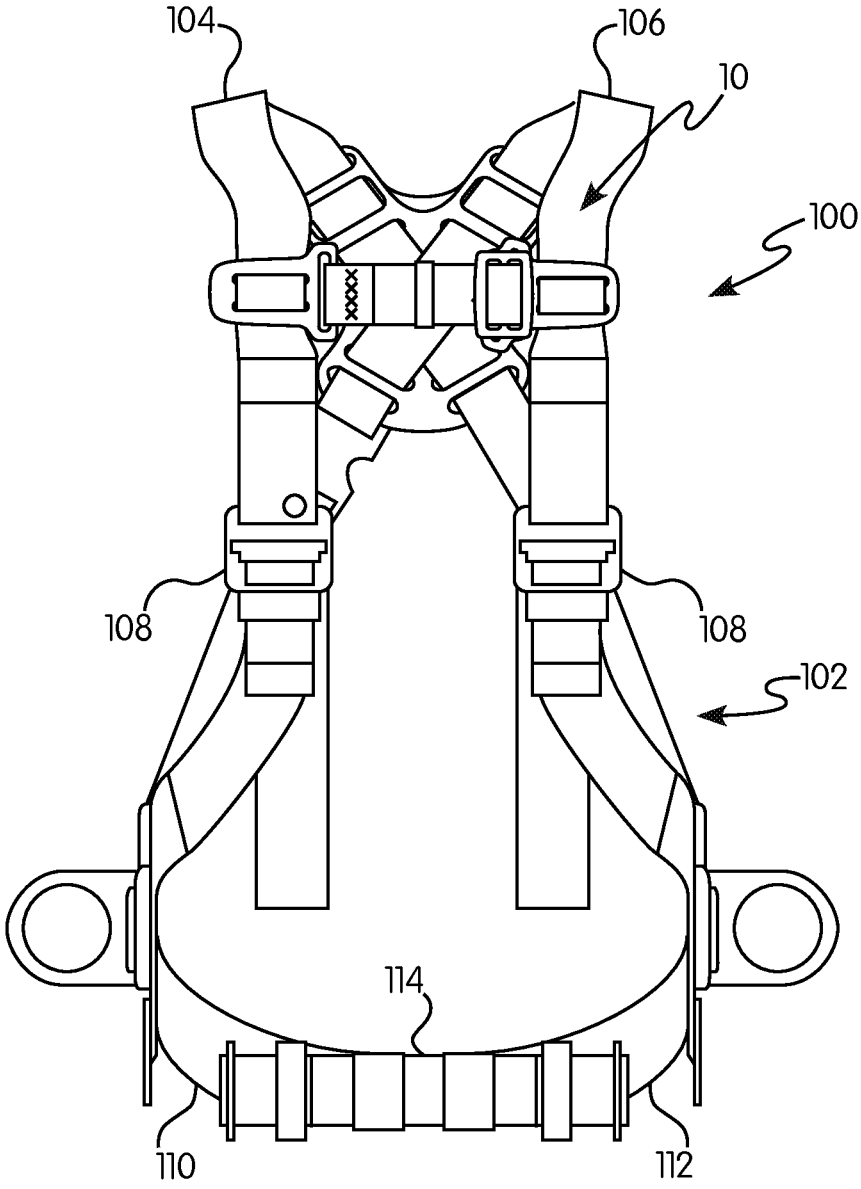
FIG. 13 is a front view of an attachable arrangement including one embodiment of a chest strap arrangement according to the principles of the present invention.

As discussed above, the chest strap arrangement 10 of the present invention can be used in connection with a variety of different attachable arrangements 100. The use of one preferred and non-limiting embodiment of the chest strap arrangement 10 of the present invention in connection with a full body harness is illustrated in FIG. 13. Of course, the present invention is equally useful in connection with any type or style of attachable arrangement 100 that requires or desires the use of a chest strap arrangement 10.

In this manner, the present invention provides a chest strap arrangement that addresses many of the drawbacks and deficiencies in the prior art. It should also be noted that by using the first buckle 18 and second buckle 32 discussed above, the chest strap arrangement 10 is easily adjustable along the first torso strap 104 and/or the second torso strap 106. In particular, the first buckle 18 may be slid along the first torso strap 104, and the second buckle 32 may be slid along the second torso strap 106, thereby allowing for adjustability of the arrangement 10 based upon the size and comfort of the user.

In addition, the present invention provides integration between certain attaching structures and hardware for use in connecting, donning, engaging, and disengaging the chest strap arrangement 10. Still further, in certain preferred and non-limiting embodiments, the present invention assists in diverting the torso straps 104, 106 away from the torso or chest area of the user, thereby increasing comfort and distribution of force in the event of a fall. Still further, and in other embodiments, the present invention reduces or eliminates the chance for slippage of the chest strap arrangement 10 in various fall situations.

Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of the appended claims. For example, it is to be understood that the present invention contemplates that, to the extent possible, one or more features of any embodiment can be combined with one or more features of any other embodiment.

What is claimed is:

1. A chest strap arrangement for an attachable arrangement removably attachable to a user and having a first torso strap and a second torso strap, the chest strap arrangement comprising:

a strap member with a first portion and a second portion;

a first buckle having an inner end area and an outer end area, and at least one substantially horizontal slot extending through at least a portion of the outer end area through which the first torso strap extends, wherein the first buckle is directly or indirectly engaged with the first portion of the strap member; and a second buckle having an inner end area and an outer end area, and at least one substantially horizontal slot extending through at least a portion of the outer end area through which the second torso strap extends, wherein the second buckle is directly or indirectly engageable with the second portion of the strap member;

wherein at least one of the first buckle and the second buckle has an inner wall with a sloped portion extending in a direction substantially parallel to the at least one substantially horizontal slot such that the cross sectional thickness of at least a portion of the outer end area of the at least one of the first buckle and the second buckle is greater than the cross sectional thickness of at least a portion of the inner end area of the at least one of the first buckle and the second buckle.

2. The chest strap arrangement of claim 1, wherein the region of greater cross sectional thickness is located at an inner wall of the at least one substantially horizontal slot of the at least one of the first buckle and the second buckle.

3. The chest strap arrangement of claim 1, wherein the cross sectional thickness of the at least one of the first buckle and the second buckle increases in a direction towards the outer end area.

4. The chest strap arrangement of claim 1, wherein the inner end area of at least one of the first buckle and the second buckle comprises a first attaching structure, the chest strap further comprising a second attaching structure engaged with the second portion of the strap member and configured to operatively interact with the first attaching structure.

5. The chest strap arrangement of claim 1, further comprising a frame member having at least one opening and positioned adjacent a rear surface of at least one of the first buckle and the second buckle, wherein at least one of the first torso strap and the second torso strap extends through the at least one opening of the frame.

6. A chest strap arrangement for an attachable arrangement removably attachable to a user and having a first torso strap and a second torso strap, the chest strap arrangement comprising:

a strap member with a first portion and a second portion;

a first buckle having an inner end area and an outer end area, and at least one substantially horizontal slot extending through at least a portion of the outer end area through which the first torso strap extends, wherein the first buckle is directly or indirectly engaged with the first portion of the strap member; and a second buckle having an inner end area and an outer end area, and at least one substantially horizontal slot extending through at least a portion of the outer end area through which the second torso strap extends, wherein the second buckle is directly or indirectly engageable with the second portion of the strap member;

wherein the inner end area of the second buckle comprises a first attaching structure, the chest strap further comprising a second attaching structure engaged with the second portion of the strap member and configured to operatively interact with the first attaching structure, and wherein the second attaching structure is disposed at an end of the strap member;

wherein at least one of the first buckle and the second buckle has an inner wall with a sloped portion extending in a direction substantially parallel to the at least one substantially horizontal slot such that the cross sectional thickness of at least a portion of the outer end area of the at least one of the first buckle and the second buckle is greater than the cross sectional thickness of at least a portion of the inner end area of the at least one of the first buckle and the second buckle.

7. The chest strap arrangement of claim 6, wherein the first attaching structure and the second attaching structure are releasably engageable.

8. The chest strap arrangement of claim 6, wherein the first attaching structure comprises a substantially vertical slot, and the second attaching structure comprises a plate member, which, when inserted through the substantially vertical slot at least partially bears against a surface of the second buckle.

9. The chest strap arrangement of claim 8, wherein the slot is formed by a first slot portion connected to and vertically misaligned with a second slot portion, thereby forming a shaped slot.

10. The chest strap arrangement of claim 6, wherein the first attaching structure comprises a shaped projection, and the second attaching structure comprises a receiving member having a body and defining an insertion slot configured to at least partially receive the shaped projection therein, thereby engaging the first attaching structure and the second attaching structure.

11. The chest strap arrangement of claim 10, wherein the receiving member comprises an actuatable release mechanism configured to releasably engage the shaped projection at least partially within the insertion slot.

12. The chest strap arrangement of claim 11, wherein the release mechanism is actuated by at least one actuation member positioned on the body of the receiving member for releasing the shaped projection from the receiving member.

13. The chest strap arrangement of claim 6, further comprising a frame member having at least one opening and positioned adjacent a rear surface of at least one of the first buckle and the second buckle, wherein at least one of the first torso strap and the second torso strap extends through the at least one opening of the frame.

14. A chest strap arrangement for an attachable arrangement removably attachable to a user and having a first torso strap and a second torso strap, the chest strap arrangement comprising:

at least one strap member;

a first buckle having an inner end area and an outer end area, and at least one substantially horizontal slot extending through at least a portion of the outer end area through which the first torso strap extends, wherein the first buckle is directly or indirectly engaged with a portion of the at least one strap member;

a second buckle having an inner end area and an outer end area, and at least one substantially horizontal slot extending through at least a portion of the outer end area through which the second torso strap extends, wherein the second buckle is directly or indirectly engaged with a portion of the at least one strap member; and a frame member positioned adjacent a rear surface of at least one of the first buckle and the second buckle;

wherein at least one of the first buckle and the second buckle has an inner wall with a sloped portion extending in a direction substantially parallel to the at least one substantially horizontal slot such that the cross sectional thickness of at least a portion of the outer end area of the at least one of the first buckle and the second buckle is greater than the cross sectional thickness of at least a portion of the inner end area of the at least one of the first buckle and the second buckle.

15. The chest strap arrangement of claim 14, wherein the frame member includes at least one opening through which at least one of the first torso strap and the second torso strap extends.

16. The chest strap arrangement of claim 15, wherein the at least one substantially horizontal slot of the first buckle and the second buckle includes a first substantially horizontal slot and a second substantially horizontal slot, and the frame member includes a first substantially horizontal opening and a second substantially horizontal opening, wherein the torso strap extends, respectively, through the first substantially horizontal opening of the frame member, the first substantially horizontal slot of the buckle, the second substantially horizontal slot of the buckle, and the second substantially horizontal opening of the frame member.

17. The chest strap arrangement of claim 14, wherein the inner end area of at least one of the first buckle and the second buckle comprises a first attaching structure, the chest strap further comprising a second attaching structure engaged with a portion of the at least one strap member and configured to operatively interact with the first attaching structure.

* * * * *